United States Patent [19]

Zobel et al.

[11] 4,347,695

[45] Sep. 7, 1982

[54] BEVERAGE BOTTLING METHOD

[75] Inventors: Frederick A. Zobel, Bedford Hills; Joseph D. Burke, Tarrytown, both of N.Y.

[73] Assignee: General Foods Corporation, White Plains, N.Y.

[21] Appl. No.: 134,232

[22] Filed: Mar. 26, 1980

[51] Int. Cl.[3] ..... B65B 31/00

[52] U.S. Cl. ..... 53/432; 141/5; 141/11; 426/397

[58] Field of Search ..... 53/403, 408, 432; 141/4–6, 11, 48, 69, 70; 426/397

[56] References Cited

U.S. PATENT DOCUMENTS 3,460,589 8/1969 Justis ..... 141/69 X 3,837,137 9/1974 Yatsushiro ..... 141/70 X

*Primary Examiner*—Frederick R. Schmidt

*Attorney, Agent, or Firm*—Daniel J. Donovan; Thomas R. Savoie

[57] ABSTRACT

A beverage-bottling method for non-carbonated beverages. An inert gas, other than carbon dioxide, such as nitrogen, is injected into a non-carbonated beverage prior to filling a container. Inert gas is permitted to escape from the beverage in the filled container before sealing the container. The amount of gas released is sufficient to strip dissolved oxygen from the beverage and then purge air from the headspace of the container. Sufficient gas is retained in the beverage to exert a superatmospheric pressure after the container is sealed. The reduction in oxygen content of the headspace is superior to that achieved with using a stream of nitrogen purging gas into the headspace, while dissolved oxygen is substantially reduced and internal container pressure is increased, the latter being a distinct advantage in containers made of flexible material such as sheet metal and plastic.

5 Claims, 2 Drawing Figures

BEVERAGE BOTTLING METHOD

BACKGROUND OF THE INVENTION

The present invention relates to a method of bottling a non-carbonated beverage. More particularly, the invention relates to a method of reducing the oxygen content of a bottled non-carbonated beverage. Still more particularly, the invention relates to a method of reducing the dissolved oxygen content and the headspace oxygen content of a bottled non-carbonated beverage.

The term "bottling" is used herein in the broad sense of packaging and is not limited to the use of a bottle as the container for the beverage. Use of cans or other vessels capable of withstanding moderate internal pressure is included.

It has been known for many years that the presence of dissolved and/or headspace oxygen has a deleterious effect on certain bottled beverages. Among these deleterious effects are those affecting the organoleptic properties of the beverage, corrosion of certain types of containers and microbial spoilage. These deleterious effects are particularly noticeable in beverages which are stored for some time as in the case of various fruit-flavored, ready-to-drink, non-carbonated beverages.

Several techniques are known for reducing the oxygen content of beverages. Among known methods are treating a citrus or vegetable juice with an inert gas (e.g., nitrogen) to reduce dissolved oxygen (McKinnis U.S. Pat. No. 2,299,553) and several methods of treating carbonated beverages (e.g., Justis U.S. Pat. No. 3,460,589, $CO_2$ or other inert gas used to purge headspace of beer containers; Benjamins U.S. Pat. No. 3,531,299; Bingham U.S. Pat. No. 3,626,996; and Mencacci U.S. Pat. No. 3,951,186 purging of beer containers; and Stone U.S. Pat. No. 2,204,833, agitation of a carbonated beverage to release $CO_2$ to purge the headspace).

It is an object of the present invention to provide an efficient method of bottling a non-carbonated beverage of reduced oxygen content. It is a further object to provide such a method in which an inert gas is employed to reduce oxygen content. It is a further object to provide such a method in which a relatively small metered quantity of inert gas is used. It is further object to provide such a method in which the internal pressure of a bottled beverage is increased in comparison to conventional bottling at the same temperature; or conventional internal pressure is obtained without the necessity of conventional beverage cooling.

BRIEF SUMMARY OF THE INVENTION

The foregoing and other objects, which will be apparent to those of ordinary skill in the art, are achieved in accordance with the present invention by providing a method of bottling a non-carbonated beverage which comprises injecting an inert gas, other than carbon dioxide, into a non-carbonated beverage to charge inert gas to said beverage, introducing the beverage containing the inert gas into a container, permitting the inert gas to escape from the beverage while the beverage is within said container and before sealing the container in an amount sufficient to strip dissolved oxygen from the beverage and purge the headspace of the container of air while retaining inert gas in said beverage in an amount sufficient to exert a superatmospheric pressure within the container when sealed, and subsequently sealing said container.

DETAILED DESCRIPTION

Figure 1:
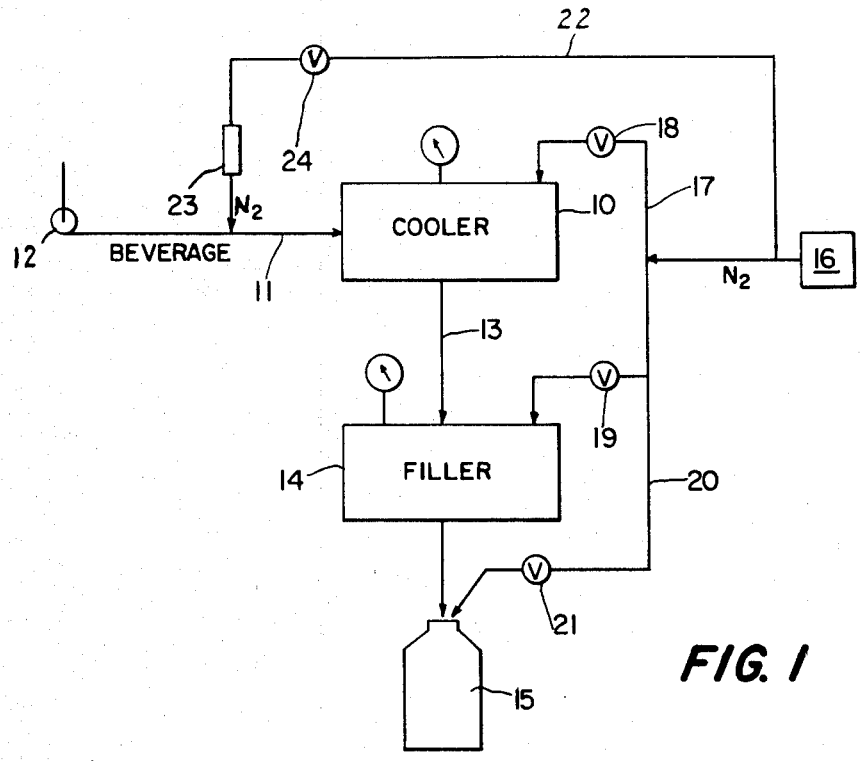
Figure 2:
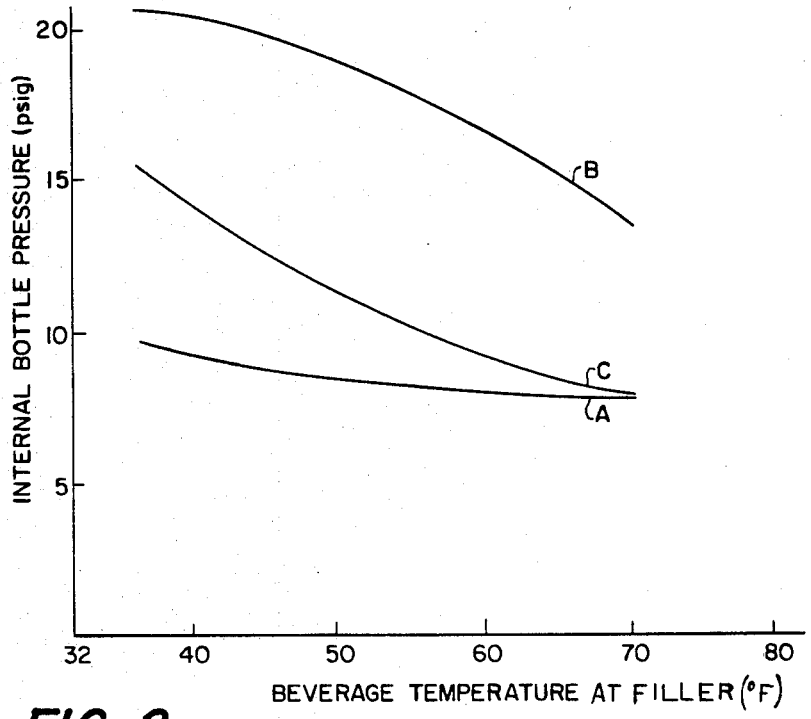

There follows a detailed description of preferred embodiments of the invention which description includes drawings in which:

FIG. 1 is a diagrammatic flow sheet of a bottling process in accordance with the invention; and FIG. 2 is a graphical representation of internal bottle pressure of non-carbonated beverages bottled in accordance with the invention as a function of beverage temperature.

The beverage to which the invention relates is any non-carbonated beverage suitable for bottling. The invention has particular suitability for ready-to-drink beverages, especially fruit-flavored, ready-to-drink beverages such as lemonade.

The inert gas which is useful in the present invention is preferably nitrogen but other inert gases, other than carbon dioxide, which are soluble or charged to and retained in the beverage temporarily, may be used.

In accordance with the invention, the inert gas is injected into the beverage before introducing the beverage into the container. This can be effected in any convenient manner such as through a small nozzle or sparger. Devices presently used for injecting carbon dioxide into carbonated beverages are quite suitable and readily available. In order to avoid or minimize the formation of excessive foam, the gas is preferably metered and injected into a flowing stream of the beverage. Where, in the bottling process, the beverage stream flows intermittently, the flow of sparging gas is preferably also intermittent and synchronized with the flow of beverage. Such synchronous flow is readily achieved automatically by the use of solenoid valves and the like. By minimizing the formation of excessive foam it is meant that liquid, when containers are filled to conventional volume, is not carried beyond the closure of the container or bottle, thus avoiding unsightly presence of beverage on the outside of the container or within the closure area.

The amount of sparger gas which is introduced is preferably enough to over-saturate the beverage with inert gas at the beverage temperature and atmospheric pressure upon release from the filler. The purpose is to permit the release of inert gas after filling. The released gas rises in the container and is sufficient to strip dissolved oxygen from the beverage and to purge the container headspace. With most beverages, the release of gas at a rate sufficiently rapid for practical bottling speed is sufficient to adequately strip dissolved oxygen and purge the container prior to capping. Any foam generation is preferably not in excess of that which will fill the headspace with foam. Accordingly, the preferred amount of over-saturation is that which will not cause the foam to more than fill the headspace of the container. It has been found that by proceeding in this manner, the amount of headspace oxygen is reduced to a level lower than to that achieved by directing a relatively much larger quantity of inert purge gas into the headspace of a filled container. In addition, the injection of nitrogen substantially reduces dissolved oxygen content and provides the ability to achieve increased internal bottle pressure after capping or closure. The amount of gas required for achieving gas overpressure at fill temperature can be determined from solubility data, as a function of temperature and pressure of filling but is also readily determined empirically. Suitable amounts of nitrogen gas for ready-to-drink lemonade beverage which differ with line speed and container geometry are given in the Examples which follow.

Filling is carried out at superatmospheric pressure, where it is desired to have a positive internal pressure in the filled and sealed container. Conventional filling equipment somewhat modified is readily employed in the practice of the present invention. It is a feature of the present invention that relatively high internal sealed bottle pressure can be achieved at relatively low filling pressure. Filling pressures of less than 100 psig are therefore employed and more preferably less than 75 psig typically 20–60 psig. Without this invention, much higher filling pressure, not possible with present commercial equipment, would be necessary.

It is a further feature of the invention that relatively high internal bottle pressure is achieved at relatively warm filling temperature. Excessive cooling requirements are avoided, reducing energy requirements. Filling temperatures are thus preferably from room temperature down to about 50° F. However, a conventional filling temperature, down to near the freezing point of the beverage, can be employed, particularly in cases where increased internal pressure is required to strengthen containers made of flexible material.

EXAMPLE I

The system employed in this example is of a conventional type used to bottle beverages and is illustrated diagrammatically in FIG. 1. A non-carbonated beverage, such as lemonade, is introduced into a cooler 10 through conduit 11 by means of a pump 12. Cooler 10 is provided with suitable cooling coils, plates, or the like for cooling the beverage. Cooled beverage is conveyed through conduit 13 to a conventional filler device 14 from which the beverage is dispensed into a container 15. The entire system is preferably automated in practice and would include conveyor means to bring a plurality of containers sequentially into position to be filled and the beverage is dispensed intermittently as each container is properly positioned adjacent the filler nozzle. A source 16 of nitrogen gas is used to supply nitrogen gas under pressure through conduit 17 to cooler 10 to pressurize cooler 10 to a value determined by pressure regulating valve 18. Nitrogen source 16 is also used to supply nitrogen under pressure through conduit 17 to filler 14 to pressurize filler 14 to a value determined by pressure regulating valve 19. Nitrogen source 16 is also used to supply a source of nitrogen purge gas through conduit 20 to purge the headspace of a container 15. Purge gas flow is controlled by valve 21.

Nitrogen source 16 is also used to supply sparging nitrogen through conduit 22 for injecting into the beverage flowing through conduit 11. The flow of sparging nitrogen is controlled by valve 24. Any suitable form of injector or sparger syncronizing nitrogen flow through conduit 22 with flow of beverage through conduit 11 can be employed such as the type conventionally used to inject carbon dioxide to carbonate a beverage. A special rotometer or other flow measuring device 23 is used to meter the flow of sparging nitrogen which is much less than carbon dioxide.

The bottling system employed for the tests has a normal line speed of 70 bottles per minute, using clear, 2 liter polyethylene terephthalate bottles for a lemonade beverage. The beverage is cooled to about 50°–55° F. and pressurized to about 55 psig in cooler 10. Nitrogen injection is accomplished by synchronizing nitrogen flow with beverage flow. This synchronizing prevents excessive foaming and economizes nitrogen. The headspace purging nitrogen is admitted through an open copper tube having a diameter of ⅜ inch and positioned with its opening about 174 inch above and slightly to the side of the top opening of a bottle and oriented to direct a stream of nitrogen purge gas downwardly into the bottle opening.

The results, which are given in Table I, show that headspace purging is not required to achieve acceptable reduction of headspace oxygen and that these low-oxygen levels are achievable by the injection of a lesser amount of nitrogen into the beverage prior to filling the containers.

TABLE I

| Run No. | 1 | 2 | 3 |
|---|---|---|---|
| Line speed (Bottles per minute) | 70 | 70 | 70 |
| Nitrogen Purge (SCFH) | 100 | 100 | 0 |
| Nitrogen Injection Rate (SCFH) | 0 | 30 | 30 |
| Product Flow Rate (GPM) | 40 | 40 | 40 |
| Pressure (psig) | | | |
| Filler | 50 | 50 | 50 |
| Cooler | 55 | 55 | 55 |
| Bottle (70° F.) | 6.0 | 15.0 | 15.0 |
| Filler Temperature (°F.) | 52 | 54 | 54 |
| Final Oxygen within sealed bottle | | | |
| Dissolved (ppm) | 2.4 | 2.0 | 2.1 |
| Headspace (%) | 10.5 | 4.4 | 4.6 |

Run 3 illustrates that the process of this invention employs 30% or less nitrogen than conventional (Run 1) to reduce headspace oxygen by one half or more. Even the low amount of dissolved oxygen was reduced. The increase in bottle pressure from 6 to 15 psig is caused by the injection process of this invention. About one half of normal refrigeration is employed since the line is run at 50°–55° F. rather than the conventional 35° F.

EXAMPLE II

A series of runs is made in equipment of the type shown in FIG. 1 and Example I over a wider range of temperatures and pressures. Nitrogen is injected at a controlled rate based on the flow of beverage and filling parameters desired. The amount of over-saturation upon release from the filler will vary somewhat and be selected depending upon the geometry of the container, line speed, the size of the headspace, the nature of the beverage, etc., but can be readily determined for any particular situation. For ready-to-drink lemonade beverage, in conventional containers, the amount of oversaturation of nitrogen at beverage temperature and atmospheric pressure will generally be in the range of 300 to 1,000%, and usually in the range of 500 to 800%. (Nitrogen solubility is approximately 0.002 to 0.003 standard cubic feet of nitrogen per gallon of beverage at 70° F. to 35° F. beverage temperature.) FIG. 2 is a graphical illustration of internal bottle pressure as a function of beverage temperature at filler 14 for these runs. Curve A is a control run in which there is no injection with nitrogen or other inert gas. Filling pressure is 59 psig. Curve B depicts results in accordance with the present invention at the same filler pressure and with the injection of nitrogen at a rate of 0.34 SCFM (71° F. filler beverage temp.) 0.5 SCFM (49° F.) and 0.58 SCFM (37° F.) at line speeds of 70, two liter bottles per minute. Curve C depicts results in accordance with the invention in which filler pressure is 35 psig, with nitrogen injection and line speed at the same rates as indicated for curve B.

One of the distinct advantages of the present invention is in obtaining high internal bottle pressure at relatively warm filling temperature, as is apparent from consideration of FIG. 2. A comparison of curve C with curve A in FIG. 2 illustrates that greater sealed bottle pressure is obtained over the total beverage temperature range using nearly one half the filler pressure. Curve B compared to Curve A illustrates that internal bottle pressure, and, therefore, firmness of flexible containers can be improved by this invention when filling at equal pressure.

EXAMPLE III

This example is carried out on bottling equipment for aluminum cans using a process similar to that depicted in FIG. 1. The bottling system employed differs from the previous examples having a normal line speed of 1,000, 12-ounce aluminum cans per minute for a lemonade beverage. The beverage was cooled to 35° F. and pressurized over a range of 20–30 psig in filler 14. Nitrogen injection is again accomplished by synchronizing nitrogen flow through conduit 22 with flow of beverage through conduit 11. The results, which are given in Table II, show that application of the nitrogen injection method of this invention achieves reduction in dissolved oxygen within the beverage. A corresponding increase in internal bottle pressure is also obtained.

TABLE II

| Run | $N_2$ Injection SCFM | Bev. Temp. @ Filler | Filler Pressure | Undercover Gases (Purge) | Internal Sealed Can Pressure* @ 68° F. | Dissolved** Oxygen |
|---|---|---|---|---|---|---|
| 4 | None | 35° F. | 30 psig | 800 SCFM | 5 | 3.1 |
| 5 | 1.9 | 35° F. | 30 psig | 800 SCFM | 10.2 | 2.1 |
| 6 | 1.7 | 35° F. | 25 psig | 800 SCFM | 8 | 2.0 |

TABLE II-continued

| Run | $N_2$ Injection SCFM | Bev. Temp. @ Filler | Filler Pressure | Undercover Gases (Purge) | Internal Sealed Can Pressure* @ 68° F. | Dissolved** Oxygen |
|---|---|---|---|---|---|---|
| 7 | 1.7 | 35° F. | 20 psig | 800 SCFM | 6.3 | 2.1 |

*Basis - Average of six samples for each filler pressure:
Standard Deviation for CanPressure
4 = 0.17
5 = 0.2
6 = 0.4
7 = 0.6
**Basis - Average of six samples:
Standard Deviation for Dissolved Oxygen
4 = 0.08
5 = 0.11

What is claimed is:

1. A method for bottling a non-carbonated beverage in which the improvement comprises injecting 3 to 10 times the amount of nitrogen required to saturate the beverage at STP, into the beverage prior to the beverage's entry into a conventional pressure filler for standard bottling with a filling pressure of less than 100 psig, introducing the beverage containing nitrogen into a container, permitting an amount of nitrogen to escape from the beverage while the beverage is within said container and exposed to ambient conditions, said amount being sufficient to strip oxygen from the beverage and purge the head-space of the container of air while retaining a sufficient amount of nitrogen in the beverage to exert a superatmospheric pressure within the container when sealed, and subsequently sealing said container.

2. A method according to claim 1 where the filling pressure is a positive nitrogen pressure of less 100 psig.

3. A method according to claim 2 where the nitrogen is injected into the beverage through a small sparging nozzle.

4. A method according to claim 2 where the nitrogen is metered.

5. A method according to claim 2 comprising the step of moving said beverage through a conduit and synchronizing the flow of metered and injected nitrogen into said moving beverage prior to the beverage entering a conventional pressure filler.

* * * * *